United States Patent [19]

Yacisin

[11] Patent Number: 4,679,966

[45] Date of Patent: Jul. 14, 1987

[54] ROOF BOLT APPARATUS WITH EXPANSION SHELL AND COUPLING

[75] Inventor: Paul A. Yacisin, Patton, Pa.

[73] Assignee: Jennmar Corporation, Pittsburgh, Pa.

[21] Appl. No.: 908,163

[22] Filed: Sep. 17, 1986

Related U.S. Application Data

[63] Continuation of Ser. No. 808,873, Dec. 13, 1985, abandoned, which is a continuation of Ser. No. 644,348, Aug. 27, 1984, abandoned.

[51] Int. Cl.[4] ..... E21D 20/02

[52] U.S. Cl. ..... 405/261; 411/2; 411/39

[58] Field of Search ..... 405/259-262; 411/2-5, 39-43, 55, 57, 60, 82

[56] References Cited

U.S. PATENT DOCUMENTS

| | | | |
|---|---|---|---|
| 3,877,235 | 4/1975 | Hill | 405/261 |
| 3,896,627 | 7/1975 | Brown | 405/261 |
| 4,051,683 | 10/1977 | Koval | 405/261 |
| 4,100,748 | 7/1978 | Hansen | 405/259 |
| 4,477,209 | 10/1984 | Hipkins | 405/261 |
| 4,516,885 | 5/1985 | Calandra | 405/261 |
| 4,516,886 | 5/1985 | Wright | 405/261 |

*Primary Examiner*—David H. Corbin

*Attorney, Agent, or Firm*—Stanley J. Price, Jr.

[57] ABSTRACT

An elongated rod with an expansion shell assembly positioned on the upper end thereof is advanced into a bore hole drilled in rock formation behind a resin cartridge system. The lower end of the rod is connected by a coupling to the upper end of a bolt having a bearing plate positioned on a lower end of the bolt emerging from the bore hole. Unitary rotation of the rod and bolt in a preselected direction while maintaining the shell assembly in an unexpanded condition effects mixing of the resin components in the bore hole. Continued rotation of the rod and bolt after the resin components are mixed effects expansion of the shell into engagement with the wall of the bore hole to anchor the rod in the bore hole. Continued rotation applied to the bolt after setting of the shell shears a pin in the coupling to permit the bolt to rotate relative to the anchored rod and move the bearing plate on the end of the bolt upwardly into compressive relation with the rock formation to put the bolt and the rod under tension without interrupting the rotation to allow the mixed resin to cure.

11 Claims, 7 Drawing Figures

ROOF BOLT APPARATUS WITH EXPANSION SHELL AND COUPLING

CROSS REFERENCE TO RELATED APPLICATIONS

This application is a continuation of copending application Ser. No. 808,873 filed on Dec. 13, 1985, entitled "Roof Bolt Apparatus With Expansion Shell and Coupling", now abandoned, which in turn is a continuation of application Ser. No. 644,348 filed on Aug. 27, 1984 and now abandoned.

BACKGROUND OF THE INVENTION

1. Field of the Invention

This invention relates to a method and apparatus for combining resin bonding and mechanical anchoring of a roof bolt apparatus in a bore hole of a rock formation and more particularly to a fully tensioned roof support system that includes a first section coupled to a second section which is both mechanically and chemically anchored in the bore hole.

2. Description of the Prior Art

It is well known to reinforce and stabilize underground rock formations, such as a coal mine roof, a subway tunnel or similar subterranean structure or to strengthen a rock mass by the use of anchor bolts inserted within a bore hole drilled in the rock formation. The anchor bolts are tensioned during installation to reinforce the unsupported rock formation above the roof, for example, above the roof of a mine passageway. Conventionally, a hole is drilled through the roof into the rock formation. The end of the bolt in the rock formation is anchored either by engagement of a mechanical expansion shell with the wall of the rock formation around the bore hole or chemically anchoring the bolt by a multicomponent resin system or grout to the rock formation surrounding the bore hole. With a chemical anchor, after the resin or grout is mixed by rotation of the bolt, the material penetrates into the surrounding rock formation to adhesively unite the rock strata and anchor, by bonding, the bolt to the rock formation surrounding the bore hole. The mixed resin or grout fills the annulus between the bore hole wall and the bolt along a substantial length of the bolt.

U.S. Pat. Nos. 3,108,443; 3,892,101; 3,940,941; 3,979,918; 4,051,683; 4,127,000; 4,129,007; 4,263,832 and 4,303,354 are examples of systems that use a grout of resin to anchor a roof bolt in a rock formation. U.S. Pat. Nos. 3,925,996 and 4,216,180 disclose multicomponent resin systems for chemically anchoring a roof bolt in a rock formation. These resin systems are quick-setting whereby, once the components are mixed, the mixture cures and begins to harden within a few seconds after mixing.

In a multicomponent resin system, the components are separated until the time that mixing and setting is desired. The components are maintained separated in compartments of a fragmentable cartridge. One or more cartridges are inserted into the bore hole, and the roof bolt is pushed into the bore hole to advance the cartridges to the closed end of the bore hole. The cartridges are ruptured, and the chemical components are mixed upon continued rotation of the bolt.

It has been the conventional practice to rotate the bolt for a period of time to thoroughly mix the components in order to insure a complete cure of the chemical mixture. Thereafter, once the chemical mixture cures and hardens, the bolt is bonded to the watt of the rock formation in the bore hole. With the quick-setting resin system disclosed in U.S. Pat. No. 4,216,180, once the resin cartridge is ruptured, the components are mixed and the mixture cures without requiring rotation of the bolt.

A roof bolt which is mechanically anchored in a bore hole is placed in tension once the upper end of the bolt is anchored in the bore hole and the roof plate is compressed into contact with the face of the rock formation surrounding the opening into the bore hole. Tensioning an anchored mine roof bolt compresses the rock strata to reinforce the strata to resist shifting of the strata above a mine passageway or an underground tunnel.

U.S. Pat. Nos. 3,940,941; 3,979,918; 4,303,354 and 4,386,877 disclose point anchor resin roof bolt support systems in which the roof bolt is chemically bonded to the rock formation and is placed in tension after the mixed resin is allowed to harden. In a chemical anchor, such as a resin cartridge system or grout, the unmixed components are advanced by the upper end of the roof bolt into the bore hole. The bolt and the chemical components are advanced into the bore hole to a position where a threaded end of the bolt emerges from the bore hole. A roof plate positioned on the emerging end of the bolt abuts against the face of the rock formation around the bore hole. A nut is positioned on the threaded end of the bolt below the roof plate. The bolt is rotated to effect mixing of the chemical components of the system, either resin or grout. After rotating the rod for a short period of time, for example five seconds in the case of a quick-setting resin, rotation is stopped to permit curing of the mixed resin components, for a preselected period of time, for example 30 to 60 seconds. After the mixed resin is cured and has hardened sufficiently, a nut is rotated on the emerging end of the bolt, but the bolt does not rotate due to the resistance to rotation presented by the cured resin surrounding the bolt. The nut is tightened against the roof plate to put the roof bolt under the desired tension.

In one method of operation the roof bolt and the nut are rotated in one direction to effect mixing of the resin components. After the components are mixed and allowed to harden, during which time the bolt is not rotated, the nut is rotated in an opposite direction on the bolt to place the bolt in tension. In another method of operation the direction of rotation for mixing the resin components is in the same direction of rotation of the nut on the bolt to tension the bolt.

U.S. Pat. Nos. 3,877,235; 4,023,373; 4,051,683; and 4,275,975 disclose a chemically anchored roof bolt system that includes an anchor portion which is inserted into the bore hole behind the resin cartridge and a lower portion connected to the anchor portion. In U.S. Pat. No. 4,023,373 the anchor portion is a pipe-like, hollow, cylindrical member into which extends the threaded end portion of a bolt. In U.S. Pat. No. 4,051,683 the anchor member is a rebar connected by a coupling to a bolt which supports the roof plate. With these devices, once the resin components have been mixed and the mixture cured and sufficiently hardened to adhesively secure the anchor portion in the bore hole, application of a predetermiend amount of torque to the bolt below the anchor portion releases the bolt for rotation relative to the anchor portion to draw the roof plate into compressive relation with the mine roof and thereby put the bolt under tension. The anchor portion is not tensioned, only the bolt is tensioned. These systems do not utilize an expansion shell to anchor the roof bolt in the bore hole.

U.S. Pat. Nos. 4,413,930 and 4,419,805 disclose method and apparatus for combining resin bonding and mechanical anchoring of a bolt in a rock formation. With these devices, a single bolt with a mechanical anchor threaded onto the upper end of the bolt is inserted into the bore hole behind the resin cartridge. A roof plate is carried on the opposite end of the bolt for abutment against the rock formation surrounding the open end of the bore hole. The cartridge is ruptured by the upward thrust and rotation of the bolt to release the resin components for mixing. A stop device associated with the expansion shell restrains expansion of the shell during rotation of the bolt in a preselected direction to mix the resin components. Rotation of the bolt continues without expansion of the shell for a predetermined period of time to permit the mixed resin to cure. As the resin mixture begins to harden and the bolt encounters resistance to rotation, the stop device is released to permit expansion of the shell into engagement with the wall of the bore hole before the mixed resin completely hardens. With this arrangement, the bolt is continuously rotated from the initial insertion to the point when a preselected torque has been applied to the bolt to put the bolt under the desired tension. Thus, the bolt is both mechanically and chemically anchored in the bore hole.

While it has been suggested by the prior art point anchor resin roof bolt devices to chemically anchor a roof bolt in a rock formation and also put the bolt under tension, the prior art devices require complete mixing and curing of the resin before the bolt is finally installed under tension. This requires that the bolt be initially rotated to mix the resin components and rotation be interrupted for a period of time to permit the resin mixture to cure. Thereafter, the bolt or a nut on the bolt is rotated in a preselected direction to put the bolt under the desired tension. Even though the development of quicksetting resins has shortened the hold time before the bolt can be fully tensioned, interruption of the bolt rotation is still required. Therefore, there is need, in the chemical anchoring of a roof bolt in a rock formation, for a system that permits continuous uninterrupted rotation of the bolt once it is inserted in the bore hole to the point of final tensioning where the resin components or grout are mixed and cured without interrupting rotation of the bolt before the bolt is placed under tension.

SUMMARY OF THE INVENTION

In accordance with the present invention, there is provided apparatus for supporting a rock formation that includes an elongated rod positioned in a bore hole of a rock formation. The rod has a first threaded end portion and a second threaded end portion. The rod first threaded end portion is positioned adjacent the bore hole. A camming plug is threadedly engaged to the rod first threaded end portion for axial movement thereon. An expandable shell has a plurality of longitudinally extending fingers spaced from one another. the fingers each have an inner surface and an outer surface. A portion of the inner surface abuts the camming plug and the outer surface is adapted to engage the wall of the bore hole. Means is associated with the camming plug for preventing axial movement of the camming plug on the bolt upon rotation of the bolt in a preselected direction. An elongated bolt is positioned in the bore hole below the rod second threaded end portion. The bolt has a first threaded end portion and a second end portion. The bolt first threaded end portion is positioned oppositely of the rod second threaded end portion. A bearing plate is positioned on the bolt second end portion. A coupling is positioned in the bore hole for connecting the bolt to the rod. The coupling has an internally threaded bore for receiving the bolt first threaded end portion and the rod second threaded end portion. Stop means is positioned in the coupling for limiting axial movement of the bolt first threaded end portion to a first position in the coupling threaded bore to permit rotation of the bolt and the rod in the preselected direction. The means associated with the camming plug is displaced upon continued rotation in said preselected direction of the bolt and the rod when a torque in excess of a predetermined torque is applied to the bolt. The camming plug is movable upon displacement of the means associated with the camming plug to expand the fingers to anchor the rod in a fixed position in the bore hole. The bolt is operable to rotate relative to the rod anchored in the bore hole upon continued rotation in the preselected direction and shear the stop means to advance in the coupling to urge the bearing plate into engagement with the rock formation and apply tension on the bolt.

Further in accordance with the present invention, there is provided a combination mechanical anchor and chemical anchor system for supporting a rock formation that includes a chemical anchor material positioned in an unmixed condition in a bore hole of a rock formation. An elongated rod is positioned in the bore hole. The rod has one end portion positioed adjacent the chemical anchor material and an opposite threaded end portion. Means is provided for mechanically anchoring the rod to the rock formation in the bore hole. An elongated bolt is positioned in the bore hole. The bolt has a threaded end portion positioned oppositely of the rod threaded end portion and an opposite end portion extending out of the opening to the bore hole. A bearing plate is retained on the bolt opposite end portion. A coupling having an internally threaded bore receives the rod threaded end portion and the bolt threaded end portion. Stop means, positioned in the coupling, maintains the bolt threaded end portion in a first position within the coupling to permit rotation of the bolt and the rod together in a preselected direction for mixing the chemical anchor material in the bore hole. Means is provided for restraining the means for mechanically anchoring the rod until the chemical anchor material is mixed. The means for mechanically anchoring the rod is engageable with the wall of the bore hole upon continued rotation of the rod in the preselected direction after mixing of the chemical anchor material. The bolt is operable to rotate relative to the rod anchored in the bore hole upon continued rotation of the bolt in the preselected direction and shear the stop means to advance in the coupling to urge the bearing plate into engagement with the rock formation and apply tension on the bolt.

Further in accordance with the present invention, there is provided a method for anchoring a bolt in a bore hole that includes the steps of positioning an expansion shell having a plurality of longitudinally extending fingers in surrounding relation with an internally threaded camming plug. The camming plug is threadedly engaged with the expansion shell mounted thereon to a threaded portion of an elongated rod. The rod is advanced, with the camming plug threadedly engaged thereto, into a bore hole in a rock formation. The rod is connected to an elongated bolt with the end of the bolt spaced from the adjacent end of the rod. A bearing plate is positioned on the bolt adjacent the rock formation externally of the bore hole. The bolt and the rod are rotated together in a preselected direction while maintaining the camming plug in fixed relation with the expansion shell and the bearing plate in spaced relation with the rock formation. Continued rotation of the bolt in the same preselected direction moves the camming plug relative to the expansion shell to expand the fingers of the expansion shell to tension the rod and anchor the rod in the bore hole. Thereafter, the bolt is rotated relative to the anchored rod to move the bolt end portion toward the adjacent end of the rod and to move the bearing plate into compressive relation with the rock formation to tension the bolt.

Accordingly, the principal object of the present invention is to provide a method and apparatus for combining resin bonding and mechanical anchoring of a roof bolt assembly in a rock formation in which an upper portion of the roof bolt assembly is mechanically anchored in a bore hole prior to curing of a mixed resin system in surrounding relation with the upper portion, and a lower portion of the roof bolt assembly connected to the upper portion is placed in tension after anchoring of the upper portion and before the resin system has completely cured to provide a roof bolt assembly that is tensioned along its entire length, as well as chemically anchored to the rock formation.

Another object of the present invention is to provide a method and apparatus for supporting a rock formation by mechanically and chemically anchoring a rod in a bore hole and connecting the rod by a coupling to a bolt so that the rod is anchored by rotation of both the rod and the bolt to set the mechanical anchor and mix the components of the chemical anchor and the bolt is advanced upwardly relative to the anchored rod to place the bolt in tension.

A further object of the present invention is to provide a combination mechanical anchor and chemical anchor system for supporting a mine roof, where installation of an expansion shell also serves to mix a multicomponent resin or grout system in a drilled bore hole by continuous rotation of a bolt without interrupting rotation to permit curing of the resins before the mechanical anchor is set and the portion of the bolt chemically anchored to the rock formation is also under tension.

An additional object of the present invention is to provide a roof bolt assembly which is both mechanically and chemically anchored in the bore hole of a rock formation to support the rock formation by continuous rotation of the assembly to initiate setting of both the mechanical and chemical anchors and place the assembly under tension along the entire length thereof.

These and other objects of the present invention will be more completely disclosed and described in the following specification, accompanying drawings and the appended claims.

DESCRIPTION OF THE PREFERRED EMBODIMENTS

Figure 1:
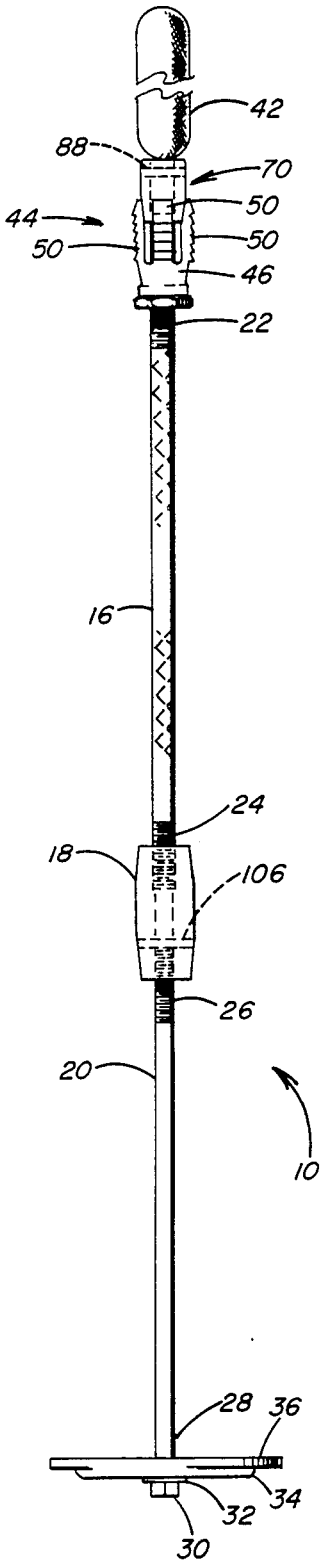
FIG. 1 is a view in side elevation of roof bolt apparatus used in combination with a multicomponent resin system to support a rock formation, illustrating a rod connected by a coupling to a bolt with a mechanical anchor positioned on the end of the rod behind the resin cartridge where the coupling includes a stop device for permitting both the rod and the bolt to rotate as a single unit to expand the shell and thereafter permit advance of the bolt relative to the rod after mixing of the resin components.
Figure 2:
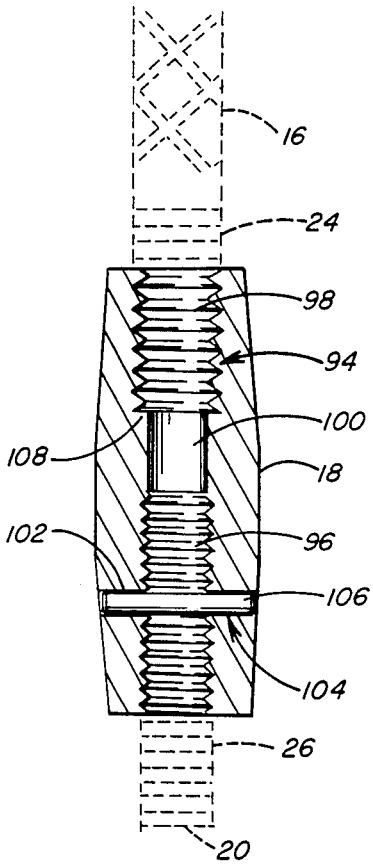
FIG. 2 is an enlarged sectional view of the coupling connecting the rod to the bolt, illustrating a shear pin extending transversely through a threaded bore of the coupling to initially retain the end of the bolt spaced from the end of the rod to permit rotation of the rod with the bolt.
Figure 3:
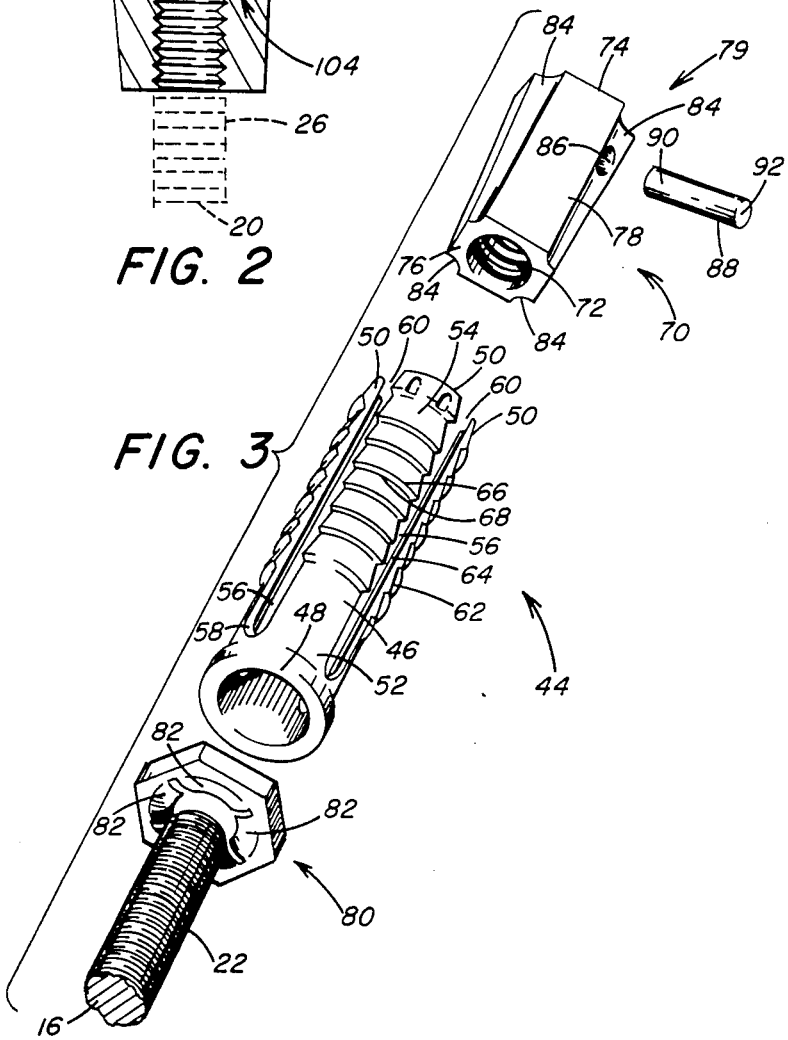
FIG. 3 is a fragmentary exploded view of an expansion shell assembly retained on the threaded end of the rod, illustrating a shear pin associated with a camming plug for initially restraining expansion of the shell member upon rotation of the rod during mixing of the components of the resin system.

Referring to the drawings and particularly to FIGS. 1–3, there is illustrated roof bolt apparatus generally designated by the numeral 10 for insertion in a bore hole 12 of a rock formation 14 (shown in FIGS. 4–7) to support the rock formation 14. The rock formation can include, for example, a mine roof that overlies a mine passageway or shaft, a subway tunnel, or other similar subterranean structure. The apparatus 10 includes a reinforcing rod 16 or the like connected by a coupling 18 to a bolt 20. The rod 16 has a first or upper threaded end portion 22 and a second or lower threaded end portion 24. The bolt 20 has a first or upper threaded end portion 26 and a second or lower end portion 28. Formed integrally on the bolt lower end portion 28 is a hexagonal head 30 and a washer 32. In one embodiment, for example, the rod 16 is a reinforcing rod of a preselected diameter, $\frac{3}{4}$ or $\frac{7}{8}$ inch, where the second end portion 24 is threaded a preselected length, for example, $4\frac{1}{2}$ inches. The rod 16 can also be a J-bar of a preselected diameter, for example of $\frac{3}{4}$ or $\frac{7}{8}$ inch. Preferably, the bolt 20 has a $\frac{3}{4}$ inch diameter and the bolt first end portion 26 is also threaded a preselected length.

Figures 4, 5, 6, 7:
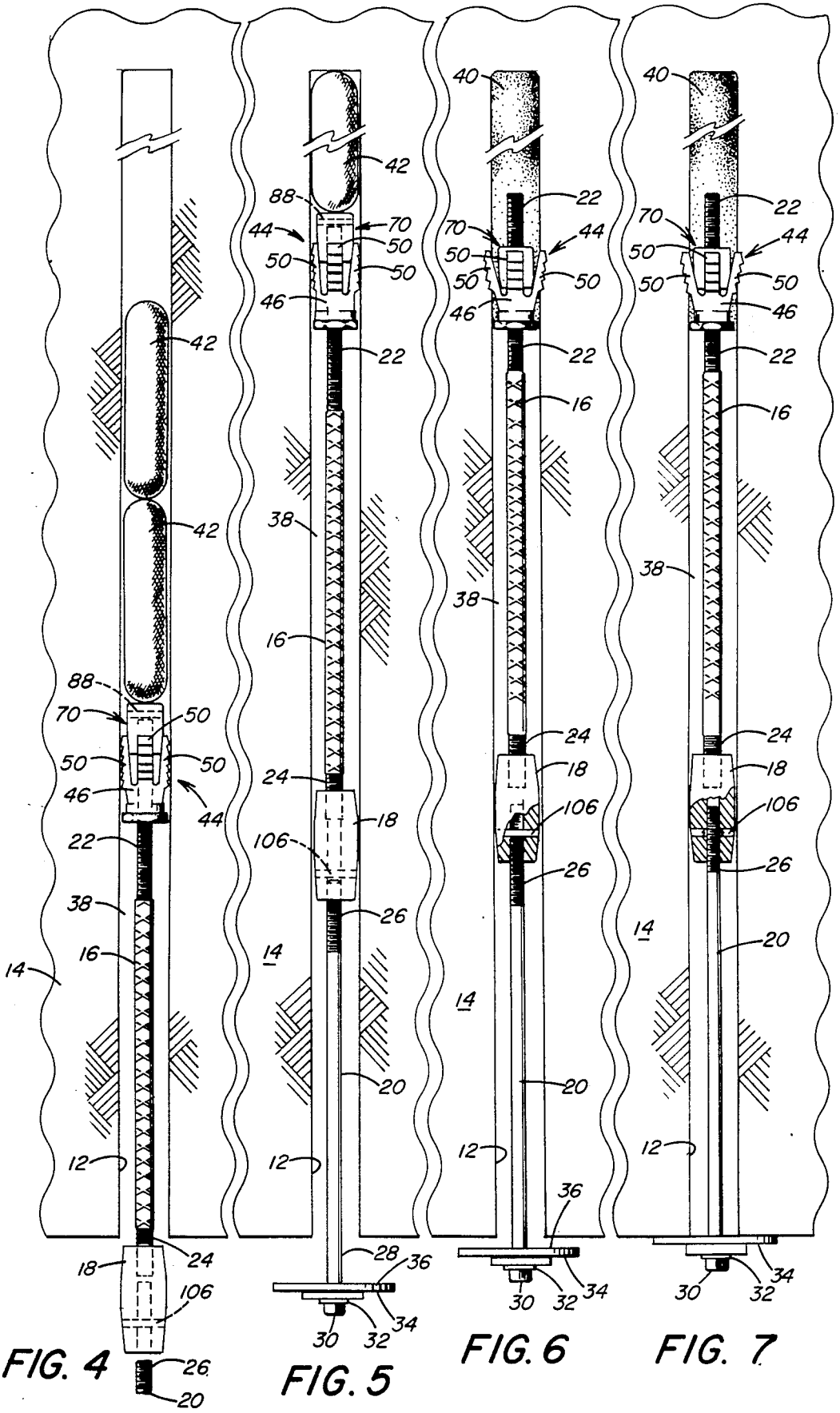
FIG. 4 is a side elevational view, partially in section, of the first step in the method of installing the roof bolt apparatus in the bore hole, illustrating a multicomponent resin cartridge system advanced in the bore hole ahead of the expansion shell assembly on the end of the rod.
FIG. 5 is a view similar to FIG. 4, illustrating the method step of installing the roof bolt apparatus by advancing the rod into the bore hole with the bolt connected by the coupling to the rod.
FIG. 6 is a view similar to FIGS. 4 and 5, illustrating the step of rotating both the bolt and the rod to mix the resin components and expand the shell in the bore hole.
FIG. 7 is a view similar to FIGS. 4–6, illustrating the fianl step of installing the roof bolt apparatus in which the bolt is advanced in the coupling relative to the tensioned and anchored rod to urge the roof plate into compressive relation with the rock formation to put the bolt under tension.

A conventional roof plate 34 is retained by the washer 32 on the lower end portion 28 of the bolt 20. The roof plate 34 has a bearing surface 36 arranged to engage the surface of the rock formation 14 at the emergent or open end of the bore hole 12, as shown in FIG. 7. The roof plate 34 supports the portion of the rock formation 14 surrounding the emergent end of the bore hole 12 to prevent degradation of the material surrounding the bore hole 12.

The reinforcing rod 16 has a diameter which is less than the diameter of the bore hole 12 forming an annulus 38, as shown in FIGS. 4–7, therebetween. The annulus 38 in the area around the rod upper end portion 22 is filled with a resin or grout mixture 40, as shown in FIGS. 6 and 7. The mixing of the resin or grout is accomplished by rotation of both the rod 16 and bolt 20 in a manner which will be described hereinafter in greater detail. The resin mixture 40 is formed from a multicomponent chemical system which is well known in the art and includes one or more fragmentable cartridges 42, shown in FIGS. 1 and 4. In a well known arrangement, each cartridge 42 includes a polymerizable resin component separated from an initiator component or catalyst. When the cartridges 42 are broken and the roof bolt apparatus 10 rotated, the components are mixed together to form a curable resin mixture which hardens, resulting in chemical anchoring of the rod 16 to the rock formation 14 surrounding the bore hole 12.

An expansion shell assembly generally designated by the numeral 44 is positioned on the upper threaded end portion 22 of the rod 16. The expansion shell assembly 44 is shown in detail in FIG. 3 and includes a shell member 46 having a ring end portion 48. A plurality of longitudinally extending finger 50 extend axially from the ring end portion 48. Each finger 50 has a lower end portion 52 connected to the ring end portion 48 and an upper end portion 54. Longitudinal slots 56 divide the fingers 50 one from another. Each slot 56 has a closed end portion 58 adjacent the ring end portion 48 and an open end portion 60 adjacent the upper end portion 54 of each finger 50.

Each finger 50 includes an outer gripping surface 62 and an inner smooth surface 64. The outer gripping surface 62 includes a gripping portion 66 that extends from the finger upper end portion 54 to a position spaced from the finger lower end portion 52. The gripping portion 66 of each finger 50 includes a series of spaced parallel, tapered horizontal grooves 68. The grooves 68 form a series of downwardly extending serrations that are operable upon expansion of the shell member 46 to engage the wall of the bore hole 12 as the fingers 50 bend outwardly.

The gripping portion 66 of each finger 50 is urged into contact with the wall of the bore hole 12 as seen in FIGS. 6 and 7, by a camming plug or wedge generally designated by the numeral 70 in FIG. 3. The camming plug 70 includes a threaded axial bore 72 for receiving the rod threaded end portion 22. The camming plug 70 has a tapered configuration with an enlarged upper end portion 74 and a reduced lower end portion 76. A portion of the inner surface 64 of each finger 50 abuts a tapered planar surface 78 of the camming plug 70.

The shell member 46 is maintained in surrounding relation with the camming plug 70 in a preselected position on the rod threaded end portion 22 by a nut generally designated by the numeral 80 in FIG. 3. The nut 80 is commercially available under the trademark "PALNUT" and includes thread engaging portions 82 which permit the nut 80 to be threaded onto the rod threaded portion 22. The nut 80 is threaded to a preselected position on the rod threaded end portion 22. The shell member 46 and the camming plug 70 are advanced to a position on the rod threaded end portion 22 to where the shell ring end portion 48 abuts against the nut 80. In this manner, the shell member 46 is retained in a preselected axial position on the rod threaded end portion 22.

As illustrated in further detail in FIG. 3, the camming plut 70 includes a plurality of longitudinally extending grooves 84 separating the planar surfaces 78. The camming plug 70 is associated with a stop device generally designated by the numeral 79. The stop device 79 includes, in one embodiment, a bore 86 that extends through the camming plug 70 transversely relative to the threaded bore 72. The ends of the transverse bore 86 emerge through a pair of oppositely aligned grooves 84 of the plug 70. A shearable pin 88 fabricated of a preselected yieldable material is positioned in the transverse bore 86. The pin 88 includes opposite end portions 90 and 92 which are retained in the transverse bore 86.

The shearable pin 88 extends transversely through the plug threaded bore 72, as shown in FIG. 1, to obstruct or prevent axial movement of the rod threaded end portion 22 beyond a preselected depth into the camming plug bore 72. Thus, upon initial assembly of the expansion shell assembly 44, the rod threaded end portion 22 is advanced into the camming plug 70 until the rod threaded end portion 22 abuts the shearable pin 88 and can advance no further into the camming plug threaded bore 72.

The location of the transverse bore 86 of the camming plug 70 is selective along the length of the camming plug, i.e. the bore 86 can be positioned adjacent the plug upper end portion 74, as shwon in FIG. 3, or at a location adjacent the plug lower end portion 76. In the alternative, the shearable pin 88 can be removed from the camming plug 70 and be retained in a transverse bore (not shown) through the rod threaded end portion 22 where the pin end portions 90 and 92 extend outwardly from the rod end portion 22. With this arrangement, the camming plug 70 is advanced downwardly on the rod end portion 22 until the lower end portion 76 of the camming plug 70 abuts the pin end portions 90 and 92. In this position, the camming plug 70 is prevented from further downward movement on the rod threaded end portion 22.

The stop device 79 in the embodiment of the shearable pin 88 is fabricated of a selected material, such as metal, wood, plastic or any other material which is operable to initially restrain relative movement between the camming plug 70 and the rod threaded end portion 22. It is the feature of the stop device 79 which restrains the shell member 46 from expanding into engagement with the wall of the bore hole 12 until the multicomponent resin system or grout 40 is mixed in the bore hole.

The type of the material and the dimensions, and particularly the cross sectional area of the pin 88 is selected to control the shearing of the pin depending upon the type of bonding material, either resin or grout, utilized and the period of time required for mixing of the chemical components. As discussed above, both quick-setting and slow-setting resin component systems are available. The type of system utilized determines the type and characteristics of the stop device 79 which is utilized.

Thus, for a quick setting resin, the pin 88 will shear within a few seconds of rotation of the rod 16. On the other hand, when a slow-setting resin system is utilized, more revolutions of the rod 16 are required for thorough mixing of the chemical components before the pin 88 shears and the shell member 46 expands. It also should be understood that the stop device 79 can include any element positioned at a preselected location in the camming plug bore 72 for obstructing advancement of the camming plug beyond a preselected point on the rod threaded end portion 22. The stop device 79 fractures when the mixed chemical componnets of the resin or grout system begin to harden and apply a force upon the expansion shell assembly 44, resisting rotation of the shell member 46 and the plug 70.

Also, the stop device 79 fractures when the torque applied to the rod 16 exceeds a predetermined torque. When the stop device 79 is no longer capable of resisting the anti-rotational forces of the mixed resin applied to the rotating expansion shell assembly 44, the stop device 79 is no longer operable to retain the shell fingers 50 in the unexpanded condition. Relative rotation between the camming plug 70 and the rod 16 is no longer prevented. The camming plug 70 is free to move downwardly on the rod threaded end portion 22 as the rod 16, together with the bolt 20, continues to rotate in the same preselected direction.

The stop device 79, in the form of the shearable pin 88, is operable for use with a wide variety of multicomponent resin or grouting systems. The shearable pin 88 is selected from a material having a preselected cross sectional area, and the pin 88 is positioned at a preselected location relative to the camming plug 70 to restrain expansion of the shell member 46 until the required mixing of the chemical components has been completed and a predetermined torque has been applied to the rod 16. Depending upon the characteristics of the chemical anchor used, the characteristics of the stop device 79 can be selected to accommodate a quick-setting resin that begins to cure within five seconds of mixing or a slow-setting resin that begins to cure within two to three minutes of mixing.

Thus the stop device 79 can embody any type of obstruction positioned in the bore 72 of the camming plug or associated with the rod threaded end portion 22 and the camming plug 70. In both cases, the stop device 79 is operable to restrain relative rotation between the camming plug 70 and the rod 16 until a predetermined torque is applied to the rod 16. Further embodiments of a stop device 79 suitable for use with the present invention include a plastic disc (not shown) selectively positioned in the camming plug bore 72 and operable to initially restrain relative movement between the camming plug 70 and the rod 16 until a predetermined torque is applied to the rod 16. When the torque applied to the rod 16 exceeds a preset amount, the plastic disc shears or fractures to permit said relative movement so that the shell member 46 can expand by movement of the camming plug 70 on the rod threaded end portion 22.

The stop device 79 can also embody a wire having end portions secured to the camming plug 70 and extending through the plug bore 72, obstructing the path of the rod 16. Also, the nut 80 with shearable thread engaging portions 82 can be utilized as a stop device. It should be understood that the stop device 79 can inlcude further embodiments which function to restrain movement of the camming plug 70 until the anti-rotational forces of the mixed resin or grout 40 applied to the camming plug 70 result in fracture or yielding of the stop device. Upon fracture or yielding of the stop device 79, downward movement of the camming plug 70 is permitted on the rod threaded end portion 22 upon continued rotation of the rod 16.

Once the mixed resin has begun to cure and to exert anti-rotational forces upon the camming plug 70, the stop device 79, for example the shearable pin 88, is no longer capable of resisting these forces. The stop device 79 shears or yields, thereby freeing the rod 16 to rotate relative to the camming plug 70. Consequently, the camming plug 70 moves downwardly on the rod threaded end portion 22 to expand the fingers 50 of the shell member 46 into engagement with the wall of the bore hole 12. This operation is carried out by continuous rotation of both the rod 16 and the bolt 20 in a single preselected direction. Preferably, the stop device 79 yields before the mixed resin completely solidifies or hardens so that the expanded fingers 50 are movable outwardly into gripping engagement with the wall of the bore hole 12.

As shown in FIG. 4, the rod 16 with the expansion shell assembly 44 positioned on the rod threaded end portion 22 is advanced upwardly behind the cartridges 42 of the multicomponent resin system into the bore hole 12. The rod 16 is inserted with the coupling 18 threaded onto the rod lower threaded end portion 24. Once the rod 16 is inserted, the bolt threaded end portion 26 is threaded inot the coupling 18. Then the reinforcing rod 16 connected to the bolt 20 is thrust upwardly into the bore hole 12.

As illustrated in detail in FIG. 2, the coupling 18 has a tubular body portion and includes a longitudinal bore generally designated by the numeral 94 that extends axially through the body portion of the coupling 18. The bore 94 has a lower threaded porion 96 separated from an upper threaded portion 98 by an unthreaded cylindrical portion 100 which is located intermediate the coupling body portion.

A bore 102 extends transversely through the coupling 18 and intersects the bore lower threaded portion 96. A stop member generally designated by the numeral 104, such as a shear pin 106, is retained in the transverse bore 102. As further illustrated in FIG. 2, the outer diameter of the coupling 18 has a diameter less than that of the bore hole 12 to permit rotation of the coupling 18 with the rod 16 and the bolt 20 in the bore hole 12. As discussed above, the rod 16 and the bolt 20 each have a diameter less than that of the bore hole 12 to permit unobstructed rotation of the rod 16 and the bolt 12 therein.

As illustrated in FIG. 2, the diameter of the bore lower threaded portion 96 in the coupling 19 is less than the diameter of the bore upper threaded portion 98. The bore cylindrical portion 100 has a diameter substantially equal to the inner diameter of the bore lower threaded portion 96. With this arrangement, a shoulder 108 is formed at the base of the bore upper threaded portion 98. The shoulder 108 serves as a stop for the rod threaded end portion 24 which is received in the bore upper threaded portion 98. the rod threaded end portion 24 is advanced into the bore upper threaded portion 98 until the extreme end of the rod 16 at the end portion 24 abuts the shoulder 108. At this point the rod 16 is connected to the coupling 18 to rotate with the coupling 18.

As seen in FIGS. 1 and 2, the bolt 20 is connected to a coupling 18 by threaded advancement of the second end or threaded end 26 of the bolt 20 into the coupling bore lower threaded portion 96. The bolt threaded end portion 26 is advanced into the bore lower threaded portion 96 into abutting relation with the shear pin 106. Contact of the bolt end portion 26 with the shear pin 106 obstructs further advancement of the bolt end portion 26 into the coupling 18.

The assembled bolt 20, coupling 18, and rod 16, with the expansion shell assembly 44 on the end thereof, are advanced upwardly behind the cartridges 42 in the bore hole 12, as shown in FIG. 5. When the cartridges 42 reach the upper closed end of the bore 12, further upward thrust of the rod 16 and bolt 20 fractures the cartridges 42 of the multicomponent resin system. Once the cartridges 42 are fractured, the resin components begin to mix. The upward thrust of the rod 16 and the bolt 20 is accompanied by rotation of both the rod 16 and the bolt 20 in a preselected direction. Also, the expansion shell assembly 44 rotates with the rod 16 to enhance the mixing of the resin components.

Rotation of the entire roof bolt apparatus 10 is effected by applying torque to the bolt head 30 below the roof plate 34. As discussed above, the stop device 79, in the form of the shear pin 88 or an equivalent device, prevents relative rotation between the camming plug 70 and the rod 16 during the initial rotation of the rod 16 to permit rupture of the cartridges 42 and mixing of the resin components before the shell member 46 is expanded. Thus, the camming plug 70 is restrained from moving downwardly on the rod 16 by the rod threaded end portion 22 abutting the shear pin 88 and the shell member 46 is maintained in an unexpanded condition.

Rotation of the rod 16 effects the mixing of the resin components. As the rod 16 is rotated, the resin components form a curable resin mixture 40 as seen in FIG. 6. The resin mixture 40 flows downwardly into surrounding relation with the expansion shell assembly 44 before it is expanded. Suitable means (not shown) such as a washer, can be positioned on the rod 16 below the rod threaded end portion 22 for retaining the mixed resin in surrounding relation with the expansion shell assembly 44 and a preselected length of the rod 16 below the assembly 44. It is well known to uitlize an elastomeric washer on the rod 16 below the expansion shell assembly 44 for preventing the resin mixture 40 from flowing beyond a certain point in the bore hole 12.

Further provisions can be made for permitting the resin mixture 40 to flow substantially down the entire length of the rod 16 to a point above the coupling 18. This is determined by the amount of resin cartridges 42 that are utilized. For example, from one to three or even more resin cartridges 42 can be utilized depending upon the length of the chemical anchor desired in the bore hole 12 in surrounding relation with the rod 16.

The rod 16, together with the bolt 20, are rotated as a unit during which time the fingers 50 of the shell member 46 are maintained in an unexpanded condition by the provision of the stop device 79 associated with the camming plug 70 and the rod upper threaded end portion 22. Given the shear characteristics of the stop device 79 corresponding to the setting characteristics of the multicomponent resin system or grout, complete mixing of the components can be completed within a few seconds of rotation of the rod 16 at which point the stop device 79 breaks away to permit expansion of the shell fingers 50. As above discussed, the expansion of the shell fingers 50 may commence within a period of time, for example after 2 to 5 seconds of rotation of the shell member 46 or within between about 20 to 30 seconds of rotation. As the rod 16 and bolt 20 are rotated to effect mixing of the resin components followed by expansion of the shell member 46, as seen in FIG. 5, the roof plate 34 isheld in close adjacency with or loosely against the rock formation 14 around the open end of the bore hole 12.

During mixing of the resin components, the rod 16 and bolt 20 are rotated together in the same preselected direction, i.e. either clockwise or counterclockwise. The resin mixture 40 flows into the fissures and faults of the rock formation 14 surrounding the bore hole 12. In this well known manner, the layers of the strata of the rock formation 14 are adhesively united to further reinforce the rock formation.

After the mixing stage, the resin mixture 40 begins to cure or harden in the bore hole 12. As the resin mixutre 40 begins to harden, the resin mixture 40 exerts forces on the rotatin shell member 46 and camming plug 70, resisting their rotation. At a predetermined torque applied to the bolt 20 after mixing of the resin components, the material strength of the shearable pin 88 is exceeded by the anti-rotational forces exerted by the resin mixture 40, and the pin 88 fractures or shears. The pin 88, or its equivalent, breaks ina manner which permits the camming plug 70 to move freely downwardly on the rod threaded portion 22 to expand the shell member 46.

As illustrated in FIG. 6, downward movement of the camming plug 70 on the rod 16 upon continued rotation of both the rod 16 and the bolt 20 in the same preselected direction expands the shell member 46. The shell fingers 50 are bent outwardly about the shell ring end portion 48 to move the outer gripping surfaces 62 into gripping engagement with the wall of the bore hole 12. Rotation of the rod 16 continues until a preselected torque is applied to the rod 16. When the desired torque limit is reached, the shellmember 46 is fully expanded and the gripping portions 66 of the fingers outer gripping surfaces 62 are embedded in the rock formation to securely anchor the rod 16 in the bore hole 12, as illustrated in FIG. 6.

Anchoring the rod 16 in the bore hole 12 by the expansion shell member 46 puts the rod 16 under the desired tension. The addition of the mixed and cured resin 40 in surrounding relation with the rod 16 and the expanded shell member 46 prevents slippage of the shell member 46 in the bore hole 12. Thus tension on the rod 16 is maintained and is not reduced by slippage of the expanded shell member 46 in the bore hole 12.

By restraining expansion of the shell assembly 44 by provision of the stop device 79, the chemical components of the resin cartridges 42 are thoroughly mixed before the shell member 46 is expanded. During the period in which the components are mixed, the fingers 50 of the shell member 46 are maintained in an unexpanded condition. However, once the rod 16 is anchored in the bore hole 12 by expansion of the shell member 46, the rod 16 is placed under tension before the resin mixture 40 has completely cured.

During the mixing stage and up to the point of the expansion of the shell member 46 into gripping engagement with the wall of the bore hole 12, the rod 16 and the bolt 20 rotate as a unit. During this period of time, the stop member 104, such as the shear pin 106, within the coupling 18 maintains the adjacent end portions of the rod 16 and the bolt 20 in spaced relation. Thus contact of the bolt end portion 26 with the shear pin 106 permits the entire roof bolt apparatus 10 to rotate as a single unit to effect both mixing of the resin components and expansion of the shell member 46 by continuous rotation of the roof bolt apparatus 10 in a single direction of rotation.

Once the resin components are mixed to form the curable mixture 40, the mixture 40 begins to harden. Consequently upon continued rotation of the rod 16, the shearable pin 88 fractures to release the shell member 46 for expansion. Once the shell member 46 has fully expanded, the rod 16 is anchored under tension in the bore hole. Rotation of the bolt 20 continues and because the rod 16 is now fixed or anchored against rotation, the pin 106 in the coupling 18 shears or breaks away to permit advancement of the bolt threaded end portion 26 further into the coupling bore lower threaded portion 96. Rotation of the bolt 20 continues until the bearing surface 36 of the roof plate 34 is brought into compressive relation with the face of the rock formation 14 surrounding the opening into the bore hole 12. With the roof plate 34 compressed against the face of the rock formation, the bolt 20 is put under tension. The bolt 20 is drawn up into the coupling 18 under tension to compress and thereby reinforce the layers of the rock strata around the bolt 20.

Interlocking the rock strata by penetration of the resin mixture 40 into the rock fissures and tensioning the rod 16 by anchoring it within the bore hole 12 by the expanded shell member 46 and tensioning the bolt 20 by securing it to the anchored rod 16 provides a roof support system that is both mechanically and chemically anchored in a bore hole. The coupled rod 16 and bolt 20 are both under tension. In this manner, the advantage of both a chemically or resin bonded roof bolt and a mechanically anchored roof bolt are achieved to provide improved reinforcement of the rock strata beyond that which is obtainable by chemical anchoring alone or mechanical anchoring alone.

By utilizing the expansion shell assembly 44, the rod 16 is tensioned in the bore hole 12. Upon expansion of the shell member 46, the stop member 104 in the coupling 18 is sheared to permit tensioning of the bolt 20 prior to complete curing of the resin mixture 40 around the rod 16. This arrangement obviates the need to hold rotation of the bolt 20 until the resin mixture 40 has completely cured. With the present invention, the resin components are completely mixed before the rod 16 and bolt 20 are tensioned; however both the rod 16 and bolt 20 are fully tensioned before the resin mixture 40 completely cures.

With the present invention, shearing of the stop member 104 in the form of the shear pin in the coupling 18 is not dependent upon curing of the resin mixture 40. Shearing of the pin 106 is initiated by expansion of the shell member 46 on the rod 16. Once mixing of the resin components is complete, for example within four or five seconds or less of rotation of the unexpanded shell member 46, the shell member 46 is expanded. The bolt 20 is continuously rotated in a preselected direction to mix the resin components, expand the shell member 46 to tension the rod 16, and tension the bolt 20 by compressing the roof plate 34 against the face of the rock formation. Thus, the entire roof bolt apparatus 10 is installed under tension by continuous rotation of the bolt 20 without interrupting the rotation to permit curing of the resin mixture 40 before the rod 16 and bolt 20 are tensioned.

According to provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. Apparatus for supporting a rock formation comprising, an elongated rod positioned in a bore hole of a rock formation, said rod having a first threaded end portion and a second threaded end portion, said rod first threaded end portion being positioned adjacent the end of said bore hole,.

an expansion shell assembly engaged to said rod first threaded end portion, an elongated bolt positioned in said bore hole below said rod second threaded end portion, said bolt having a first threaded end portion and a second end portion, said bolt first threaded end portion being positioned oppositely of said rod second threaded end portion, a bearing plate positioned on said bolt second end portion, means for threadedly connecting said bolt to said rod, stop means associated with said means for threadingly connecting said bolt to said rod for limiting axial movement of said bolt relative to said rod to permit unitary rotation of both said bolt and said rod in a preselected direction, said expansion shell assembly being operable upon rotation of said rod to anchor said rod in said bore hole, and said bolt being operable to rotate in said preselected direction relative to said rod anchored in said bore hole to disengage said stop means to axially advance said bolt relative to said rod and tension said bolt.

2. Apparatus for supporting a rock formation as set forth in claim 1 in which said expansion shell assembly includes, a camming plug threadedly engaged to said rod first threaded end portion for axial movement thereon, an expansion shell having a plurality of longitudinally extending fingers spaced from one another, said fingers each having an inner surface and an outer surface, a portion of said inner surface abutting said camming plug and a portion of said outer surface adapted to engage the wall of said bore hole, said camming plug being operable upon rotation of said rod to expand said fingers and anchor said rod in a fixed position in said bore hole.

3. Apparatus for supporting a rock formation as set forth in claim 2 which includes, means associated with said expansion shell assembly for preventing relative movement between said camming plug and said expandable shell upon rotation of said rod in said preselected direction, and said means associated with said expansion shell assembly being operable upon rotation of said rod a preselected number of rotations in said preselected direction to move said camming plug on said rod and expand said fingers to anchor said rod in a fixed position in said bore hole.

4. A combination mechanical anchor and chemical anchor system for supporting a rock formation comprising, chemical anchor material positioned in a bore hole of a rock formation, an elongated rod positioned in said bore hole, said rod having one end portion positioned adjacent said chemical anchor material and an opposite threaded end portion, means for mechanically anchoring said rod in said bore hole, an elongated bolt positioned in said bore hole, said bolt having a threaded end portion positioned oppositely of said rod threaded end portion and an opposite end portion extending out of said bore hole, a bearing plate positioned on said bolt opposite end portion, means for threadingly connecting said rod to said bolt, stop means associated with said means for maintaining said bolt threaded end portion in a first axial position to permit rotation of said bolt and said rod together in a preselected direction, said means for mechanically anchoring said rod being engageable with the wall of said bore hole upon rotation of said rod in said preselected direction, and said bolt being operable to rotate relative to said rod anchored in said bore upon continued rotation of said bolt in said preselected direction to disengage said stop means and advance said bolt relative to said rod to urge said bearing plate against the rock formation and tension said bolt.

5. A combination mechanical anchor and chemical anchor as set forth in claim 4 which includes, means for restraining said means for mechanically anchoring said rod until at least a portion of said chemical anchor material is mixed, said means for mechanically anchoring said rod being engageable with the wall of said bore hole upon rotation of said rod in said preselected direction after mixing at least a portion of said chemical anchor material.

6. A combination mechanical anchor and chemical anchor as set forth in claim 4 in which said means for mechanically anchoring said rod in said bore hole includes, a camming plug threadedly engaged to said rod adjacent said chemical anchor material and arranged to move axially on said rod, an expandable shell having a plurality of longitudinally extending fingers spaced from one another, said fingers each having an inner surface and an outer surface, a portion of said inner surface abutting said camming plug and said outer surface adapted to engage the wall of said bore hole.

7. A combination mechanical anchor and chemical anchor as set forth in claim 4 which includes, and means for restraining said means for mechanically anchoring said rod until at least a portion of said chemical anchor material is mixed.

8. A combination mechanical anchor and chemical anchor as set forth in claim 6 which includes, means associated with said camming plug for preventing axial movement of said camming plug on said rod upon rotation of said rod in a preselected direction, said means associated with said camming plug being displaced upon rotation of said rod in said preselected direction upon mixing of at least a portion of said chemical anchor material, and said camming plug being movable upon displacement of said means associated with said camming plug to expand said fingers to anchor said rod in a fixed position in said bore hole.

9. A method of anchoring a bolt in a bore hole comprising the steps of, threadedly engaging an expansion shell assembly to a threaded end portion of an elongated rod, advancing said rod with said expansion shell assembly threadedly engaged thereto into a bore hole of a rock formation, threadedly connecting said rod to an elongated bolt, positioning a bearing plate on the bolt, rotating said bolt and said rod in a preselected direction and expanding said expansion shell assembly to anchor said rod in said bore hole, and thereafter rotating said bolt in the same preselected direction an relative to said anchored rod to move the bolt relative to said anchored rod and urge the bearing plate against the rock formation and tension said bolt.

10. A method for anchoring a bolt in a bore hole comprising, positioning an expansion shell assembly including an expansion shell having a plurality of longitudinally extending fingers surrounding an internally threaded camming plug on an upper threaded end portion of a rod, threadedly engaging said camming plug with said expansion shell mounted thereon to said upper threaded end portion of said rod, inserting at least one cartridge of chemical anchor material in said bore hole, thereafter inserting said rod with said expansion shell assembly thereon into said bore hole, threadedly connecting said rod to an elongated bolt, positioning a bearing plate on said bolt adjacent the rock formation externally of said bore hole, advancing said rod and said elongated bolt into said bore hole and fracturing said cartridge of chemical anchor material with said rod and expansion shell assembly, rotating said bolt and rod in a preselected direction to mvoe said camming plug relative to said expansion shell to expand said expansion shell fingers and anchor said rod in said bore hole, and thereafter rotating said bolt in the same preselected direction relative to said anchor rod to move said bolt end portion axially relative to said rod and urge said bearing plate against the rock formation and tension said bolt.

11. A method for anchoring a bolt in a bore hole as set forth in claim 10 which includes, rotating said bolt and rod in a preselected direction while maintaining said camming plug in fixed relation with said expansion shell while mixing at least a portion of said chemical anchor material in said bolt hole.

* * * * *